United States Patent [19]

Harada

[11] 4,074,169

[45] Feb. 14, 1978

[54] MAGNETRON WITH HARMONIC FREQUENCY OUTPUT SUPPRESSION

[75] Inventor: Akikazu Harada, Mobara, Japan

[73] Assignee: Hitachi, Ltd., Tokyo, Japan

[21] Appl. No.: 713,859

[22] Filed: Aug. 12, 1976

[30] Foreign Application Priority Data

Sept. 19, 1975 Japan ..... 50-112687

[51] Int. Cl.[2] ..... H01J 25/587

[52] U.S. Cl. ..... 315/39.75; 315/39.51; 315/39.53; 315/39.77

[58] Field of Search ..... 315/39.51, 39.53, 39.75, 315/39.77

[56] References Cited

U.S. PATENT DOCUMENTS

| | | | |
|---|---|---|---|
| 2,478,534 | 8/1949 | Kather | 315/39.71 X |
| 2,854,603 | 9/1958 | Collier et al. | 315/39.77 |
| 3,041,497 | 6/1962 | Clampitt et al. | 315/39.77 |
| 3,169,211 | 2/1965 | Drexler et al. | 315/39.77 |
| 3,636,403 | 1/1972 | Edwards et al. | 315/39.51 |
| 4,006,382 | 2/1977 | Butler et al. | 315/39.53 |

*Primary Examiner*—Saxfield Chatmon, Jr.
*Attorney, Agent, or Firm*—Charles E. Pfund

[57] ABSTRACT

In a magnetron of the class comprising an anode cylinder, radial vanes mounted on the inner surface of the anode cylinder, and a cathode structure disposed along the axis of the anode cylinder, non-magnetic annular rings, frustums or cylinders are mounted on the pole pieces of the permanent magnets or on the inner surface of the anode cylinder to cause the end spaces on both ends of the anode cylinder to resonate at the second higher harmonic which is desired to be suppressed.

8 Claims, 7 Drawing Figures

MAGNETRON WITH HARMONIC FREQUENCY OUTPUT SUPPRESSION

BACKGROUND OF THE INVENTION

This invention relates to a magnetron constructed to prevent generation of noise.

A magnetron generating a microwave at a high efficiency is widely used in various high frequency apparatus, such as a microwave range, a radar and the like.

FIG. 1 shows a longitudinal sectional view of a prior art magnetron comprising an anode cylinder 11 provided with a plurality of radial vanes 12 secured to the inner wall thereof. At the center of the anode cylinder 11 is disposed a cathode structure 13. Frustum shaped pole pieces 14 and 15 are disposed on the opposite ends of the anode cylinder. An antenna 17 extends through the pole piece 14 between the space in which the vanes 12 are located, and an output terminal 16 and three load conductors 19, 20 and 21 connected to the cathode structure 13 extend upwardly through the center of the other pole piece 15. Permanent magnets 23 and 24 are disposed close to the pole pieces 14 and 15 respectively and flux focusing rings 26 and 27 are disposed between the permanent magnet 23 and the pole piece 14 and between the permanent magnet 24 and the pole piece 15. A plurality of heat radiating fins 28 are provided to surround the anode cylinder 11 and the component parts described above are contained in an iron casing 29. A casing 31 containing a filter 32 for suppressing the unwanted electromagnetic wave leakage propagating through the input terminal of the cathode voltage is secured to the top of the casing 29. A gasket 33 is mounted on the inner periphery of the casing 29 and a stem 35 is provided at the top center of the casing 29 for supporting the lead conductors 19, 20 and 21. A support 36 for supporting the stem 35 is also mounted on the magnetic pole piece 15. The vanes 12 and the cathode structure 13 define an interaction space 37 and on both ends thereof are defined end spaces 38 and 39 by opposite ends of the anode cylinder 11, vanes 12 and pole pieces 14 and 15.

When an input is supplied to the cathode structure 13 through the filter 31, the electrons emitted by the cathode structure undergo a whirling motion whereby a microwave energy is radiated through antenna 17 and output terminal 16 which is utilized to cook foodstuffs in a microwave range.

Although most of the microwave energy generated in this manner comprises the fundamental wave, many unwanted waves such as second, third and other higher harmonics as well as sideband frequencies are also generated. Furthermore, in the prior art construction the end spaces 38 and 39 are merely designed to cause the magnetic flux from the pole pieces 14 and 15 to flow in parallel through the interaction space 37 without regard to the resonance frequency in the end spaces 38 and 39 so that the resonance frequency usually has a resonance point between 3.5 to 4.5 GHz. For this reason, all unwanted waves, especially higher harmonic waves having a large energy leak to the outside via antenna 17 or the cathode structure 13 thus affecting nearby communication apparatus or television receiving sets. Although filter 31 is provided for the cathode structure 13 for preventing such leakage of the unwanted electric waves, it is impossible to perfectly prevent the leakage. Among the higher harmonics the second harmonic has the largest energy thus creating the most serious problem.

SUMMARY OF THE INVENTION

Accordingly, it is an object of this invention to provide a magnetron having an improved construction capable of preventing leakage of unwanted waves which adversely affect nearby communication apparatus and television receiving sets.

Another object of this invention is to provide an improved magnetron of improved safeness and capable of efficiently preventing leakage of unwanted waves.

A further object of this invention is to provide an improved magnetron capable of preventing leakage of unwanted waves without the necessity of changing the basic design of the component parts that have been utilized in the conventional magnetron.

According to this invention, there is provided a magnetron of the class comprising an anode cylinder, vanes extending toward the axis of the anode cylinder from the inner wall thereof and a cathode structure positioned along the axis of the anode cylinder, wherein end spaces are defined at both ends of the anode cylinder, characterized by comprising a non-magnetic member disposed in at least one of the end spaces for causing the one end space to resonate at an unwanted frequency other than the fundamental wave frequency thereby preventing unwanted electromagnetic wave from leaking to the outside of the magnetron.

In one embodiment, the non-magnetic member comprises an annular ring or a hollow frustum mounted on the pole piece of the permanent magnet. In another embodiment the non-magnetic member comprises a cylindrical member securred to the inner surface of the anode cylinder.

DESCRIPTION OF THE PREFERRED EMBODIMENTS

Figure 1:
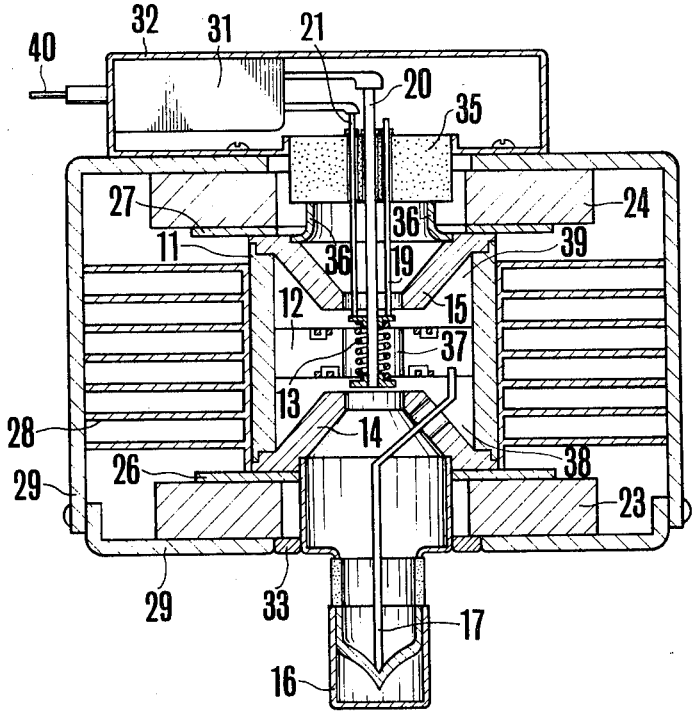
FIG. 1 PRIOR ART
FIG. 1 is a longitudinal sectional view showing the construction of a typical prior art magnetron.
Figure 2:
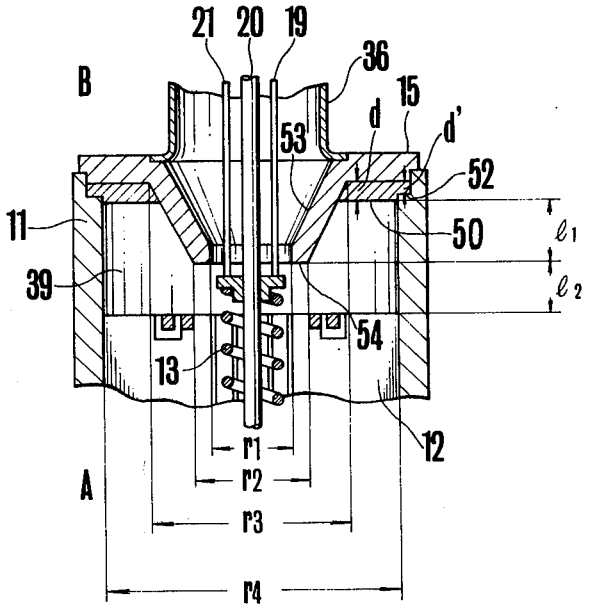
FIG. 2 is a longitudinal sectional view showing a portion of a magnetron embodying the invention, especially the upper end space and the component parts adjacent thereto.

FIG. 2 shows a portion of a magnetron embodying the invention, especially the upper end space 39 and nearby component parts in which component parts identical to those shown in FIG. 1 are designated by the same reference numerals. As shown, a non-magnetic annular ring 50 having a thickness *d* is clamped between the inner surface of the magnetic pole piece 15 and a shoulder 52 at the upper end of the anode cylinder 11. A shoulder is formed on the periphery of the annular ring 50 for engaging the shoulder 52 of the anode cylinder 11. The annular ring 50 is provided with a central opening for engaging the base portion of the conical portion 53 of the pole piece 15. To assemble these component parts while the anode cylinder 11 is maintained in an inverted position, the annular ring 50 is mounted on the shoulder 52 and then the conical portion 53 of the pole piece 15 is inserted into the central opening of the annular ring 50, thus clamping the same between the anode cylinder 11 and the pole piece 15. The annular ring 50 is made of non-magnetic material for the purpose of preventing leakage of the magnetic flux from the interaction space 37.

Considering the electric characteristics of the end space 39 of the magnetron, it can be considered that the conical portion 53 and the anode cylinder 11 form a coaxial line in which the conical portion 53 comprises the inner conductor and the anode cylinder 11 comprises the outer conductor and that the conical portion 53 and the vanes 12 form a capacitor. Denoting the length of the coaxial line portion by $l_1$ and that of the capacitor portion by $l_2$ and assuming that the end space resonates at a frequency having a wavelength λ, the following equation is obtained.

$$Z_o \tan\left(\frac{2\pi}{\lambda} \cdot l_1\right) = \frac{1}{wc} \quad (1)$$

where $Z_0$ represents the characteristic impedance of the coaxial line constitutes by the anode cylinder 11 and the pole piece 15, C the electrostatic capacitance of the capacitor constituted by the end of the pole piece 15 and the vanes 12, and ω the angular frequency of the electromagnetic wave having a wavelength λ.

For this reason where the thickness *d* of the annular ring 50 and the position of the shoulder 52 of the anode cylinder 11 are selected to vary the lengths $l_1$ and $l_2$ as well as the resonance parameters of the end space which are necessary to suppress any higher harmonic having a desired frequency, for example the second harmonic. Thus, by varying the thickness *d* of the annular ring 50 between the pole piece 15 and the anode cylinder 11, the length $l_1$ is varied, and varying the thickness *d'* of the shoulder on the periphery of the annular ring 50, the distance between the inner end 54 of the conical portion 53 of the pole piece 15 and the vanes 12 is varied. Accordingly, it is possible to vary the resonance frequency of the end space 39 as above described.

Further, according to this embodiment it is possible to secure the annular ring by merely clamping it between the shoulder 52 of the anode cylinder 11 and the pole piece 15 without using a solder.

Figure 3:
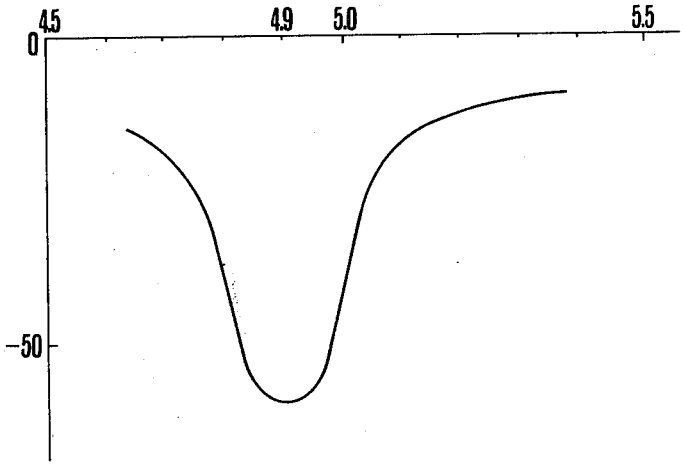
FIG. 3 is a higher harmonic suppressing characteristic of the embodiment shown in FIG. 2.

Some examples of the dimensions of the various elements are as follows. When the inner diameter $r_1$ of the inner end of the conical portion 53 is equal to 10mm, its outer diameter $r_2$ is equal to 16mm, the base outer diameter $r_3$ of the conical portion 53 is equal to 29mm, the inner diameter $r_4$ of the node cylinder 11 is equal to 39mm, $l_1$ = 3.0mm and $l_2$ = 2mm, the end space 39 resonated at the second higher harmonic of 4.9GHz, thus obtaining a higher harmonic suppressing characteristic as shown in FIG. 3, wherein the abscissa represents the resonance frequency and the ordinate the relative amount of transmission. As can be noted from FIG. 3, the magnetron of this invention can greatly suppress higher harmonics having a frequency of 4.9 GHz and multiples thereof. The term "relative amount of transmission" means the amount of transmission of the wave to input side B when the wave is transmitted from the output side A of the magnetron shown in FIG. 2.

When a non-magnetic annular ring is used as in this embodiment the ring can be mounted by merely clamping it between the pole piece 15 and the anode cylinder, so that it is not necessary to change the design of the component parts of the magnetron or to perform any special machining.

Figure 4:
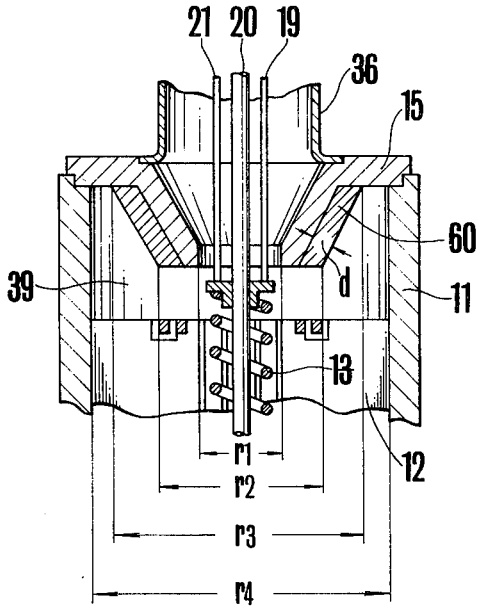
FIGS. 4 to 7 show other embodiments of this invention.

FIG. 4 shows another embodiment of this invention in which elements corresponding to those shown in FIG. 2 are designated by the same reference numerals. In this case a frustum shaped non-magnetic member 60 having a thickness *d* is fitted over the conical portion 53 of the pole piece 15. By varying the thickness *d* of the frustum shaped member 60 so as to satisfy equation (1) for a specific higher harmonic desired to be suppressed it is possible to cause the end space 39 to resonate at that higher harmonic thus suppressing the desired higher harmonic.

Typical dimensions of this embodiment are as follows. $r_1$ = 10mm, $r_2$ = 16mm, $r_3$ = 29mm, $r_4$ = 39mm, $l_1$ = 3.0mm and $l_2$ = 2mm, where $r_1$, $r_2$, $r_3$, $r_4$, $l_1$ and $l_2$ have the same meaning as above described. Then, the end space 39 resonates at the second higher harmonic having a frequency of 4.9 GHz in the same manner as the first embodiment, and a high *f* frequency suppression characteristic substantially the same as that shown in FIG. 3 was obtained.

The annular ring 50 shown in FIG. 1 and the frustum shaped member 60 shown in FIG. 4 are not always necessary to be continuous but may be provided with openings, slits or notches.

Figure 5:
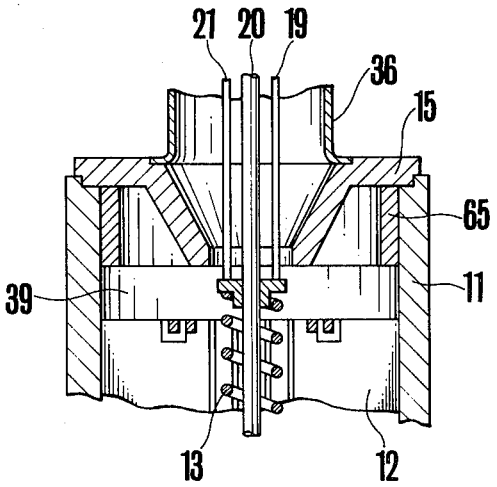

Further, the invention is not limited to the embodiments described above but various changes and modifications may be made. For example, in still another embodiment shown in FIG. 5, a non-magnetic cylinder 65 is soldered to the inner surface of the anode cylinder 11 with its upper end abutted to the pole piece 15. In this construction too, the cylinder 65 forms a portion of a coaxial line in the same manner as in the foregoing embodiments so that the end space 39 acts as a cavity that resonates at the unwanted higher harmonic.

Figure 6:
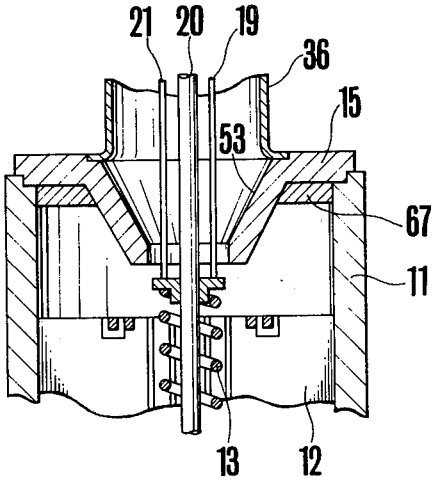

Another embodiment shown in FIG. 6 is similar to that shown in FIG. 2 except that the periphery of a non-magnetic annular ring 67 having a predetermined thickness is soldered to the inner periphery of the anode cylinder 11.

Figure 7:
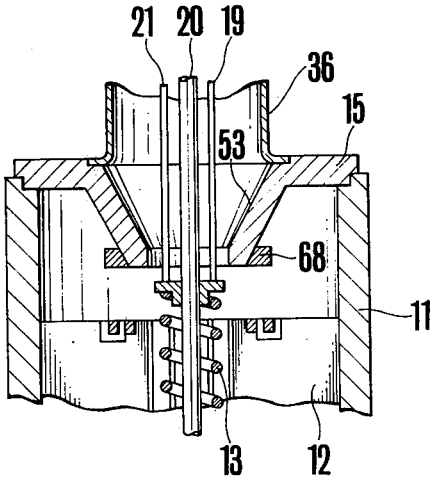

In still another embodiment shown in FIG. 7 a non-magnetic ring 68 having a predetermined thickness is fitted over the end of the conical portion 53 of the pole piece 18. These modifications can also attain the objects of this invention. It is only necessary that the configuration and size of the non-magnetic member can vary the parameters that determine the resonance frequency of the end space 39.

It will be clear that the ring shaped members 50, 65, 67 or 68 may be integrally bonded to the anode cylinder 11 or the pole pieces 14 and 15. Any non-magnetic material such as stainless steel, copper, etc. can also be used.

Although in the foregoing description, the end spaces 38 and 39 were caused to resonate at the second higher harmonic, it is also possible to cause them to resonate to any other higher harmonics having a large energy.

Further, in addition to the inner pole type and the outer pole type magnetron, the invention is also applicable to the so-called magnet containing type magnetron having no pole piece.

What is claimed is:

1. In a magnetron of the class comprising an anode cylinder, vanes extending toward the axis of said anode cylinder from the inner wall thereof, and a cathode structure positioned along the axis of said anode cylinder, wherein end spaces are defined at both ends of said anode cylinder, the improvement which comprises a non-magnetic axially symmetric annular member disposed in at least one of said end spaces for causing said one end space to resonate to an unwanted frequency other than the fundamental wave frequency thereby preventing unwanted electro-magnetic wave from leaking to the outside of said magnetron.

2. The magnetron according to claim 1 wherein said non-magnetic member takes the form of an annular ring.

3. The magnetron according to claim 2 which further comprises at least one permanent magnet provided with a pole piece for passing magnetic flux to an interaction space between said vanes, and wherein said surface of said annular ring abuts against said pole piece, and the periphery of said annular ring is clamped between said anode cylinder and said pole piece.

4. The magnetron according to claim 2 which further comprises at least one permanent magnet provided with a pole piece for passing magnetic flux to an interaction space between said vanes, and wherein one surface of said annular ring abuts against said pole piece, and the periphery of said annular ring abuts against the inner surface of said anode cylinder.

5. The magnetron according to claim 1 which further includes at least one permanent magnet provided with a frustum shaped pole piece projecting toward an interaction space defined between said vanes and defining said end space, and wherein said annular member takes the form of a hollow frustum filter on said pole piece.

6. The magnetron according to claim 1 which further comprises at least one permanent magnet provided with a frustum shaped pole piece for passing magnetic flux to an interaction space defined between said vanes and forming said end space, and wherein said non-magnetic member comprises a cylindrical member with one end abutted against said pole piece and the periphery secured to the inner wall of said anode cylinder.

7. The magnetron according to claim 1 which further comprises at least one permanent magnet provided with a frustum shaped pole piece for passing magnetic flux to an interaction space defined between said vanes, one end of said anode cylinder being connected to said pole piece and wherein said non-magnetic member comprises a ring mounted on the top of said frustum shaped pole piece.

8. The magnetron according to claim 1 wherein said non-magnetic member is shaped to cause said end space to resonate at the second higher harmonic of the fundamental wave.

* * * * *